United States Patent [19]

Rydgren

[11] Patent Number: 5,031,486

[45] Date of Patent: Jul. 16, 1991

[54] CORKSCREW

[75] Inventor: Jan Rydgren, Vestby, Norway

[73] Assignee: Rydgren Promotion A/S, Vestby, Norway

[21] Appl. No.: 477,635

[22] Filed: Feb. 9, 1990

Related U.S. Application Data

[63] Continuation-in-part of Ser. No. 411,898, Sep. 25, 1989, abandoned.

[30] Foreign Application Priority Data

May 19, 1989 [NO] Norway ..... 892027
Nov. 8, 1989 [NO] Norway ..... 894457

[51] Int. Cl.[5] ..... B67B 7/04
[52] U.S. Cl. ..... 81/3.45; 81/3.48
[58] Field of Search ..... 81/3.48, 3.45, 3.07, 81/3.36, 3.29

[56] References Cited

U.S. PATENT DOCUMENTS 179,090 6/1876 Barnes ..... 81/3.45
2,093,541 9/1937 Bohler ..... 81/3.45
4,291,597 9/1981 Allen ..... 81/3.48
4,574,662 3/1986 Jones ..... 81/3.48

FOREIGN PATENT DOCUMENTS 938167 1/1956 Fed. Rep. of Germany ..... 81/3.45

*Primary Examiner*—Roscoe V. Parker
*Attorney, Agent, or Firm*—Dressler, Goldsmith, Shore, Sutker & Milnamow, Ltd.

[57] ABSTRACT

Corkscrew comprising a handle and a helically-shaped screw part, where the helically-shaped part (2) being formed is extended spirally, having its smallest diameter near the handle, and being flat with the outside aligning with a conical envelope surface, the terminating end (3) remote from the handle also being flat but being arranged radially and perpendicularly to the center axis of the corkscrew, the screw part having decreasing diameter toward the end (3) from the point where the screw part is twisted from a position aligned with the conical surface, to a position perpendicular to the center axis, and a center peg (1) being secured to the handle, concentric to the screw part (2).

5 Claims, 2 Drawing Sheets

CORKSCREW

Figure 1:
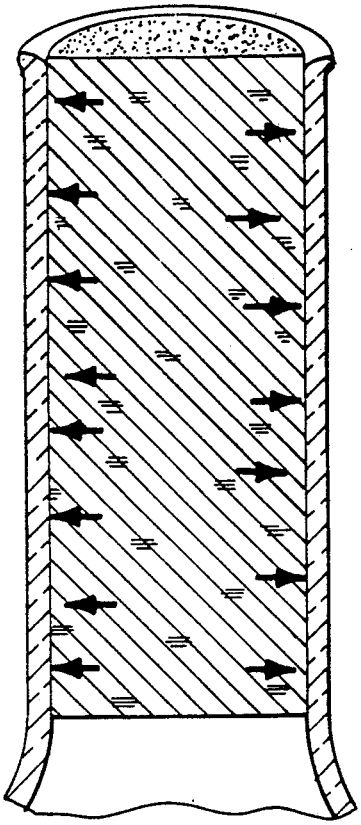

This application is a continuation-in-part of application Ser. No. 411,898, filed Sept. 25, 1989, now abandoned.

The present invention is related to a corkscrew.

Throughout the times, a plurality of tools has been developed for pulling a cork out of a bottle's neck. The most commonly used design is the well known helically shaped screw which is to be screwed into the middle or near the middle of the cork, normally through a substantial part of the cork and often through the full length of the cork, which very easily breaks out parts of the cork which fall down into the bottle.

By screwing a traditional corkscrew into a cork, the cork mass is compressed by the corkscrew in such a way that the pressure of the cork against the wall of a bottle neck increases considerably. when the cork by means of the corkscrew is pulled out, an additional force has to be overcome created by the friction between the cork and the wall and the additional pressure caused by the compression of the cork. The volume of the cork is increased approximately 15% when the corkscrew is screwed in whereby additionally the grip of the corkscrew in the cork is limited to approximately 30 to 40% of the volume of the cork, positioned in the center of the cork which thereby in fact is remote from the circumference of the cork where the friction forces are acting. From time to time, this fact leads to breaking of the cork, especially if the cork has poor quality.

It is therefore an objective for the present invention to provide a corkscrew where the friction forces between the cork and the wall of the bottle neck are decreased instead of increased as the case is by known corkscrews. It is a further purpose of the present invention displacing the grip of the corkscrew in the cork from the center of the cork, nearer to the circumference of the cork thereby simultaneously to displace the forces from the corkscrew nearer to the friction forces between the cork and the bottle neck.

The above-mentioned objectives are achieved with the corkscrew according to the present invention as defined by the features stated in the patent claim.

Figure 2:
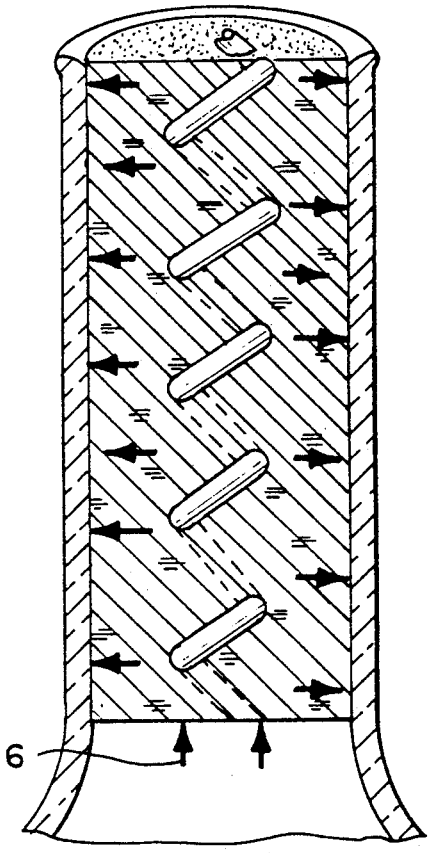
Fig. 2 PRIOR ART
Figure 3:
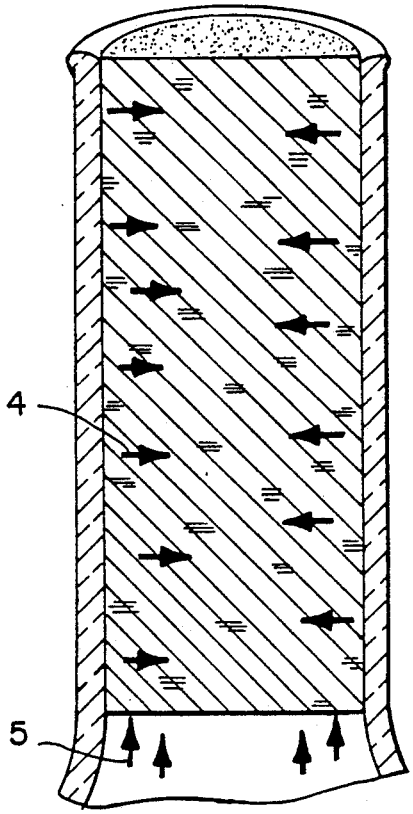
Figure 4:
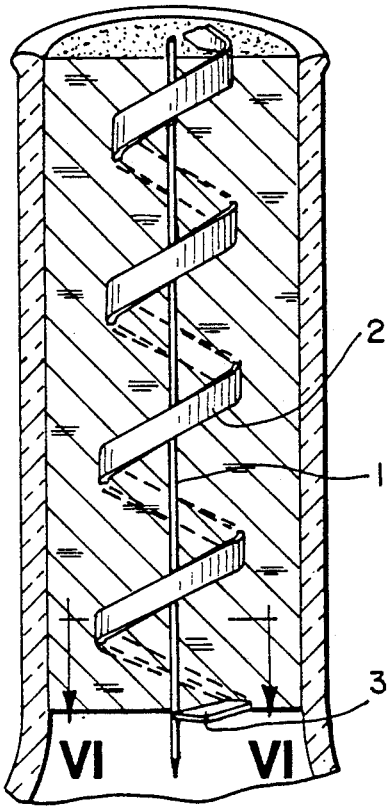
Figure 5:
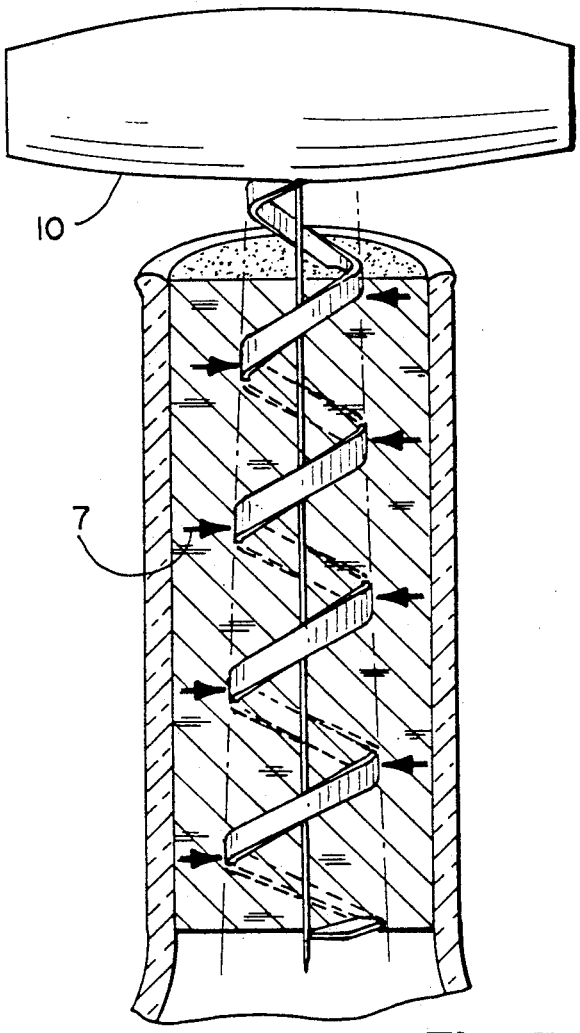
Figure 6:
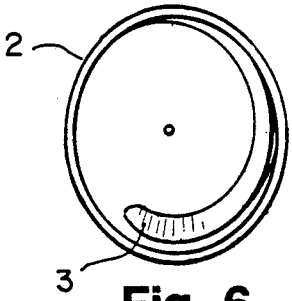

In the drawing,

FIG. 1 discloses a section through a bottle neck and a cork;

FIG. 2 discloses a section corresponding to FIG. where a known corkscrew is screwed in;

FIG. 3 discloses a corresponding section with arrows indicating the forces present by use of the corkscrew according to the present invention;

FIG. 4 discloses a corresponding section with the corkscrew according to the present invention inserted;

FIG. 5 discloses a section corresponding to FIG. 4 with arrows indicating the forces;

FIG. 6 discloses a section along VI—VI in FIG. 4; and

Figure 7:
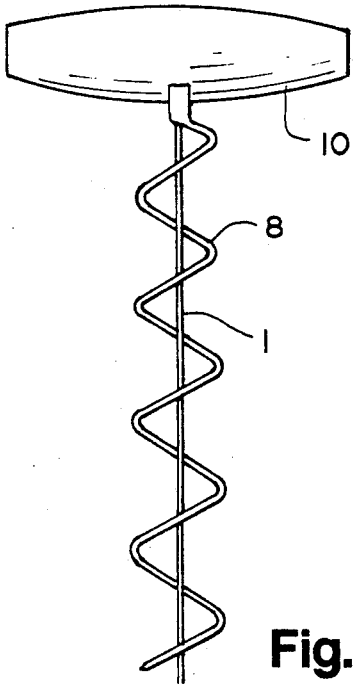

FIG. 7 discloses a side view of a simplified embodiment.

In FIG. 1 are disclosed, by arrows, the forces between the cork and the wall of the bottle neck, due to the compression of the cork in the bottle neck. Forces due to pressure in the interior of the bottle are not considered in this connection.

FIG. 2 discloses, also by arrows, additional forces from a corkscrew of traditional type which is screwed into the center of the cork.

FIG. 3 discloses, by arrows, the forces which are present when the cork is pulled out of the bottle by means of the corkscrew according to the present invention. The friction forces between the cork and the wall of the bottle are decreased. The cork will experience radially inwardly directed forces as disclosed with arrows 4. Arrows 5 disclose that axial forces act on the cork considerably closer to the circumference of the cork than the arrows 6 in FIG. 2 which substantially are limited to the middle of the cork.

FIGS. 4–6 disclose the corkscrew according to the present invention. A center peg 1 is secured to handle 10, ensuring that the corkscrew to be kept centric in the cork thereby uniformly to distribute the forces towards the circumference. The center peg 1 may be hollow thereby allowing air to be led into the bottle when screwing the corkscrew into the cork. The corkscrew 2 itself has an outer helical and conical shape with the smallest diameter near the handle 10. The corkscrew 2 substantially is made as a flat band arranged in the cone surface. The lowest part of the corkscrew, however, is twisted away from the position where the band is parallel to the conical surface, to a position substantially perpendicular to the axis of the cork and the center peg 1, respectively, terminating in a flat end 3. The conical shape of the corkscrew has an increasing diameter substantially from the handle 10 to the point near the end of the corkscrew where the twisting of the band starts, from the position parallel with the conical surface, to the position of the flat end 3, which is arranged substantially perpendicular to the center peg. From the point where the twisting starts and to the end 3, the diameter is decreasing as disclosed in FIG. 6. By screwing the corkscrew according to the present invention into the cork, the corkscrew is brought into and maintained substantially concentric in the cork. The flat end 3 will dig into the cork and by the design of the windings, firstly, with increasing diameter, thereafter, starting at the twisting point, with decreasing diameter, the cork itself will assume radially inwardly directed forces as disclosed with the arrows 7 in FIG. 5.

When the cork is pulled out of the bottle by means of the corkscrew according to the present invention, the flat end 3 will have a good grip in the cork, transferring the forces into the cork at the lower end of the cork. In this way it is ensured that the cork is pulled out of the bottle in one unit which is made easy by the radially inwardly directed forces occurring by screwing the corkscrew into the cork. Additionally, radially inwardly directed forces will be executed in the cork from the axial force on the handle as the helical shape of the corkscrew thereby will transfer additionally radial forces towards the center of the cork.

FIG. 7 discloses a simplified embodiment of the corkscrew according to the present invention where the flat band type corkscrew 2 is replaced by a corkscrew 8 having a substantially circular cross section. Such a design simplifies substantially manufacturing and in most cases it will give acceptable effect together with the center peg 1 and the substantially conical shape of the screw from the handle with an increasing diameter towards a point near the end of the screw, from which the diameter is decreasing towards the end.

By means of the corkscrew according to the present invention an increased grip surface is achieved and a considerably reduced pressure against the wall bottle neck, whereby the center peg maintains the corkscrew concentric in the cork when the corkscrew is screwed into the cork.

What is claimed is:

1. A corkscrew comprising a handle and a helically-shaped flat screw part with the outside aligning with a conical envelope surface with its smallest diameter near the handle, the terminating end remote from the handle being arranged radially and perpendicular to the center axis of the corkscrew, the screw part having a decreasing diameter toward the end from the point where the screw part is twisted from a position aligned with a conical surface to a position perpendicular to the center axis, and a center peg secured to the handle, concentric to and spaced from the screw part outside said handle and extending at least to the end of the screw part.

2. Corkscrew according to claim 1, characterized in that the conical shape in the area near the end of the screw part, opposite the handle, has a decreasing diameter.

3. Corkscrew according to claim 1, characterized in the screw part having a substantially circular cross section.

4. A corkscrew comprising a handle and a helically shaped screw part, characterized in that the helically shaped part is formed as an extended conical spiral having its smallest diameter near the handle, and having a center peg secured to the handle, concentric to and spaced from the screw part throughout its entire length outside said handle and extending at least to the end of the screw part.

5. Corkscrew comprising a handle and a helically-shaped screw part, characterized in the helically-shaped part (2) being formed as an extended spiral having its smallest diameter near the handle, and being flat with the outside aligning with a conical envelope surface, the terminating end (3) remote from the handle also being flat but being arranged radially and perpendicularly to the center axis of the corkscrew, the screw part having decreasing diameter towards the end (3) from the point where the screw part is twisted from a position aligned with the conical surface, to a position perpendicular to the center axis, and a center peg (1) being secured to the handle, concentric to the screw part (2).

* * * * *